US006081238A

United States Patent [19]

Alicot

[11] Patent Number: 6,081,238

[45] Date of Patent: Jun. 27, 2000

[54] EAS SYSTEM ANTENNA CONFIGURATION FOR PROVIDING IMPROVED INTERROGATION FIELD DISTRIBUTION

[75] Inventor: Jorge Alicot, Davie, Fla.

[73] Assignee: Sensormatic Electronics Corporation, Deerfield Beach, Fla.

[21] Appl. No.: 08/887,821

[22] Filed: Jul. 3, 1997

Related U.S. Application Data

[63] Continuation of application No. 08/452,968, May 30, 1995, abandoned.

[51] Int. Cl.[7] ..... H01Q 7/00

[52] U.S. Cl. ..... 343/742; 343/867

[58] Field of Search ..... 343/742, 867; 340/572; H01Q 7/00, 21/00, 11/12

[56] References Cited

U.S. PATENT DOCUMENTS

| | | | |
|---|---|---|---|
| 2,207,781 | 7/1940 | Brown | 343/744 |
| 4,243,980 | 1/1981 | Lichtblau | 340/572 |
| 4,251,808 | 2/1981 | Lichtblau | 340/572 |
| 4,309,697 | 1/1982 | Weaver | 340/572 |
| 4,373,163 | 2/1983 | Vandebult | 343/842 |
| 4,394,645 | 7/1983 | Humble et al. | 340/572 |
| 4,486,731 | 12/1984 | Westcott | 336/212 |
| 4,633,250 | 12/1986 | Anderson, III et al. | 342/27 |
| 4,634,975 | 1/1987 | Eccleston et al. | 324/232 |
| 4,679,046 | 7/1987 | Curtis et al. | 342/51 |
| 4,701,764 | 10/1987 | Malcombe | 343/742 |
| 4,859,991 | 8/1989 | Watkins et al. | 340/572 |
| 4,872,018 | 10/1989 | Feltz et al. | 343/742 |
| 4,922,261 | 5/1990 | O'Farrell | 343/742 |
| 5,049,857 | 9/1991 | Plonsky et al. | 340/551 |
| 5,051,726 | 9/1991 | Copeland et al. | 340/572 |
| 5,061,941 | 10/1991 | Lizzi et al. | 343/742 |
| 5,081,469 | 1/1992 | Bones | 343/895 |
| 5,126,749 | 6/1992 | Kaltner | 343/742 |
| 5,130,697 | 7/1992 | McGinn | 340/551 |
| 5,218,371 | 6/1993 | Copeland et al. | 343/742 |
| 5,321,412 | 6/1994 | Kopp et al. | 343/742 |
| 5,341,125 | 8/1994 | Plonsky et al. | 340/572 |
| 5,373,301 | 12/1994 | Bowers et al. | 343/742 |
| 5,387,900 | 2/1995 | Plonsky et al. | 340/572 |
| 5,404,147 | 4/1995 | Drucker et al. | 343/742 |
| 5,440,296 | 8/1995 | Nelson | 340/572 |

*Primary Examiner*—Michael C. Wimer
*Attorney, Agent, or Firm*—Robin, Blecker & Daley

[57] ABSTRACT

In an electronic article surveillance system, quadrature transmitting and receiving antennas are used to improve field distribution. A transmitting antenna arrangement includes first and second adjacent co-planar antenna loops and excitation circuitry for generating respective alternating currents in the first and second loops such that the respective alternating currents are 90° out of phase. In a receiving arrangement, respective signals received from two adjacent co-planar antenna loops are respectively phase-shifted by +45° and −45°, and the resulting phase-shifted signals are summed. A far-field cancelling transmitting antenna arrangement includes four loops operated at phases of 0°, 90°, 180° and 270° respectively. All four loops may be co-planar, with any bucking vertical segments being horizontally displaced from each other. Alternatively, the 0° and 180° loops may also be arranged in a common plane that is close to and parallel with another plane in which the 90° and 270° loops are arranged.

6 Claims, 11 Drawing Sheets

EAS SYSTEM ANTENNA CONFIGURATION FOR PROVIDING IMPROVED INTERROGATION FIELD DISTRIBUTION

This application is a continuation of application Ser. No. 08/452,968, filed May 30, 1995 abandoned.

FIELD OF THE INVENTION

This invention relates to antenna configurations, and more particularly to antennas for use with electronic article surveillance (EAS) systems.

BACKGROUND OF THE INVENTION

An electronic article surveillance system 20 is shown in schematic terms in FIG. 1. The system 20 is typically provided at the exit of a retail store to detect the presence of a marker 22 in an interrogation zone 24 defined between antenna pedestals 26 and 28. When the system 20 detects the marker 22, the system 20 actuates an alarm of some kind to indicate that an article (not shown) to which the marker 22 is secured is being removed from the store without authorization.

Customarily, each of the antenna pedestals 26 and 28 is generally planar and includes one or more loop antennas. Signal generating circuitry 30 is connected to the antenna or antennas in pedestal 26 to drive the antennas in pedestal 26 to generate an interrogation signal in the interrogation zone. Also, receiver circuitry 32 is connected to the antenna or antennas in the pedestal 28 to receive and analyze signals picked up from the interrogation zone by the antennas in the pedestal 28.

For purposes of further discussion, a coordinate system 34, consisting of X, Y and Z axes, mutually orthogonal to each other, is shown in FIG. 1. The antenna pedestals 26 and 28 are usually arranged in parallel to each other, and for the purposes of this and further discussion, it should be understood that the respective planes of the pedestals 26 and 28 are parallel to the plane defined by the Z and X axes. The Z axis is presented as being a vertical axis, and the X axis is a horizontal axis extending in the direction of a path of travel through the interrogation zone 24, i.e., parallel to the planes of the pedestals 26 and 28. The Y axis is also horizontal, but in a direction perpendicular to the X axis. For some purposes, the X direction will be referred to as the "horizontal direction", the Z direction will be referred to as the "vertical direction", and the Y direction will be referred to as the "lateral direction".

The marker 22 typically includes a coil or other planar element that receives the interrogation signal generated through the antenna pedestal 26 and retransmits the signal, in some fashion, as a marker signal to be detected through the antenna pedestal 28. The amplitude of the marker signal is, in general, dependent on the orientation of the plane of the receiving element in the marker 22. As a practical matter, the orientation of the plane of the receiving element has three degrees of freedom, but the response of the marker can be analyzed in terms of components corresponding to three orthogonal plane orientations. These will be referred to as a "horizontal orientation", corresponding to the plane defined by the X and Y axes, a "vertical orientation", corresponding to the plane defined by the Z and X axes, and a "lateral orientation", corresponding to the plane defined by the Z and Y axes.

For markers used in magnetomechanical EAS systems, the marker responds to flux that is co-planar with the marker, but for markers that include a coil, the marker responds to flux that is orthogonal to the plane of the coil. Subsequent discussions herein will be based on the assumption that a magnetomechanical marker is in use.

It is generally an objective in an EAS system that the system reliably detect any marker in the interrogation zone, regardless of position in the zone or orientation of the marker. At the same time, it is highly desirable that the system not produce false alarms either by interpreting a signal generated by a non-marker object in or out of the interrogation zone as coming from a marker, or by stimulating markers not in the interrogation zone to generate signals at a level sufficiently high to be detectable by the receiver circuitry.

One significant obstacle to achieving these objectives is the uneven interrogation field distribution commonly provided by antennas used for generating the interrogation signal. As a result of the uneven field distribution, the interrogation field may be strong enough at some or most locations in the interrogation zone to provide for detection of a marker, while not being strong enough at other locations to provide for detection. The locations in which the field is too weak to provide for detection are sometimes referred as "null" areas or "holes".

This problem is aggravated by the fact that the strength of the signal generated by the marker is dependent on the orientation of the marker. Accordingly, a marker at a given location in the zone and oriented in a first manner may be readily detectable, while if the marker is at the same location but oriented in a different manner, the marker would not be detected.

One approach that has been contemplated for overcoming this problem is simply to increase the overall strength of the interrogation field, i.e., by increasing the level of the signal used to generate the interrogating antenna.

Aside from the increased power consumption requirements resulting from this approach, there are often regulatory or other practical constraints on the peak signal level that can be generated. For example, increasing the peak field strength could lead to increased false alarms from either or both of non-marker objects in the interrogation zone and markers located outside of the intended interrogation zone.

Further, in addition to the usual desire to confine the interrogation field to the intended zone, it may be a regulatory requirement, or desirable for other reasons, to provide far-field cancellation of the interrogation signal. This requirement places additional constraints on the design of the antenna used for generating the interrogation signal.

OBJECTS AND SUMMARY OF THE INVENTION

It is accordingly an object of the invention to provide an antenna configuration for use in an electronic article surveillance system which results in a relatively even effective field distribution in an interrogation zone.

It is a further object of the invention to provide an antenna configuration which produces far-field cancellation of the interrogation signal.

According to an aspect of the invention, there is provided an antenna for use with an EAS system, including first and second adjacent co-planar loops, and excitation means for generating respective alternating currents in the first and second loops such that the respective alternating currents in the first and second loops are 90° out of phase. In certain preferred embodiments of the invention, the antenna does not include any loops other than the aforesaid first and second loops, or at least no other loops that are arranged in the common plane of the first and second loops.

Further in accordance with this aspect of the invention, the excitation means preferably includes a signal source connected to the first loop for directly generating the respective alternating current in the first loop, and the first and second loops are inductively coupled such that the respective alternating current in the first loop inductively generates the respective alternating current in the second loop with a 90° phase offset from the respective alternating current in the first loop.

According to another aspect of the invention, there is provided an antenna for receiving an alternating signal in an EAS system including first and second adjacent loops with the loops being inductively coupled such that the alternating signal induces respective alternating currents in the loops with a 90° phase offset.

According to yet another aspect of the invention, there is included an antenna configuration for use with an EAS system, including a first planar antenna arranged in a first plane, a second planar antenna including at least two loops arranged in a second plane that is substantially parallel to the first plane, the first and second antennas overlapping in a direction normal to the planes, first excitation means for generating an alternating current in the first antenna, and second excitation means for generating respective alternating currents in the loops of the second antenna, the respective alternating currents in the loops being 180° out of phase with each other and 90° out of phase with the alternating current in the first antenna.

Further in accordance with this aspect of the invention, the first antenna preferably includes at least two loops arranged in the first plane and the first excitation means includes means for generating respective alternating currents in the loops of the first antenna such that the respective alternating currents in the loops in the first antenna are 180° out of phase with each other.

According to still another aspect of the invention, there is provided an antenna for use in an EAS system, including first, second, third and fourth co-planar loops, and excitation means for generating respective alternating currents in the first, second, third and fourth loops, such that the alternating current in the second loop is 90° out of phase with the alternating current in the first loop, the alternating current in the third loop is 180° out of phase with the alternating current in the first loop, and the alternating current in the fourth loop is 180° out of phase with the alternating current in the second loop, and the four loops collectively include a plurality of vertical sections with no two vertical sections in the antenna being vertically aligned with each other.

Alternatively, in accordance with this aspect of the invention, the four loops collectively include at least one pair of vertical segments having respective alternating currents that are 180° out of phase with each other, but in each of such pairs of vertical segments, the two vertical segments making up the pair of vertical segments are displaced horizontally with respect to each other. As another alternative in accordance with this aspect of the invention, the four loops collectively include at least one pair of vertical segments that are vertically aligned, and in each such pair of vertical segments the respective alternating currents in the two vertical segments making up the pair of segments are in a phase relationship that is substantially different from 180° out of phase. For example, in each pair of vertically aligned vertical segments, the respective currents are in phase or 90° out of phase.

An antenna configuration provided according to the invention, in which there are no vertically aligned vertical segments with "bucking" currents, tends to prevent the formation of holes due to near-field cancellation, as has commonly resulted from prior art far-field cancelling antenna configurations.

Further in accordance with the latter aspects of the invention, the four loops may all be rectangular or may all be triangular.

In accordance with yet another aspect of the invention, there is provided an apparatus for receiving a signal present in an interrogation zone of an electronic article surveillance system, with the signal alternating at a predetermined frequency, and the apparatus including a first receiver coil for receiving the signal and providing a first receive signal which alternates at the predetermined frequency, a second receiver coil adjacent to the first receiver coil for receiving the signal that is present in the interrogation zone and providing a second received signal which alternates at the predetermined frequency, a receive circuit, and quadrature means for providing the first and second received signals to the received circuit with a 90° phase offset between the first and second received signals. Preferably, the quadrature means includes a first shift circuit that phase-shifts the first received signal by +45° and a second shift circuit which phase-shifts the second received signal by −45°, and the quadrature means also includes a summation circuit which sums the first and second shifted signals to produce a sum signal which is outputted to the received circuit. The first shift circuit may be a low pass filter and the second shift circuit may be a high pass filter.

According to a further aspect of the invention, there is provided an antenna arrangement for use with an EAS system, including a first planar loop arranged in a first plane, a second planar loop arranged in a second plane that intersects the first plane at an angle $\theta$, with $0°<\theta<180°$, and excitation circuitry for generating respective alternating currents in the first and second loops such that the respective alternating currents in the first and second loops are 90° out of phase.

According to still another aspect of the invention, there is provided an antenna arrangement for use with an EAS system, including first and second co-planar loops, and excitation circuitry for generating respective alternating currents in the first and second loops such that the respective alternating currents in the first and second loops are 90° out of phase, the first and second loops being displaced from each other in a horizontal direction.

According to yet another aspect of the invention, there is provided an antenna arrangement for use with an EAS system, including first and second co-planar loops, and excitation circuitry for generating respective alternating currents in the first and second loops such that the respective alternating currents in the first and second loops are 90° out of phase, the first loop having a contour that is different from a contour of the second loop.

According to still a further aspect of the invention, there is provided an antenna arrangement for use with an EAS system, including a plurality of co-planar loops which includes first and second loops, and excitation circuitry for generating respective alternating currents in the first and second loops such that the respective alternating currents in the first and second loops are 90° out of phase, with at least two of the plurality of co-planar loops being substantially triangular.

According to still a further aspect of the invention, there is provided an antenna arrangement for use with an EAS system, including first, second and third co-planar loops, and excitation circuitry for generating respective alternating currents in the first, second and third loops such that the respective alternating currents in the first and second loops are 90° out of phase, and the respective alternating currents in the first and third loops are 180° out of phase with each other, with the antenna arrangement having no other antenna loops that are co-planar with the first, second and third loops.

According to yet another aspect of the invention, there is provided an antenna arrangement for use in an EAS system, including first and second adjacent co-planar loops, and excitation circuitry for generating respective alternating currents in the first and second loops such that the respective alternating currents are substantially in phase during a first sequence of time intervals and are substantially 180° out of phase with each other during a second sequence of time intervals interleaved with the first sequence of time intervals, with the antenna arrangement having no other antenna loops that are co-planar with the first and second loops.

According to still another aspect of the invention, there is provided an antenna configuration for use with an EAS system, including a first planar antenna arranged in a first plane, a second planar antenna including at least two loops arranged in a second plane that is substantially parallel to the first plane, with the first and second antennas overlapping in a direction normal to the planes, a first excitation circuit for generating an alternating current in the first antenna only during a first sequence of time intervals, and a second excitation circuit for generating respective alternating currents in the loops of the second antenna only during a second sequence of time intervals interleaved with the first sequence of time intervals, with the respective alternating currents in the loops of the second antenna being about 180° out of phase with each other.

According to still a further aspect of the invention, there is provided an antenna arrangement for use with an EAS system, including first, second and third co-planar loops, with the first loop circumscribing the second and third loops, and excitation circuitry for generating respective alternating currents in the first, second and third loops such that the respective alternating currents in the first and second loops are about 90° out of phase, and the respective alternating currents in the second and third loops are about 180° out of phase with each other.

According to yet another aspect of the invention, there is provided an antenna arrangement for use with an EAS system including first, second and third co-planar loops, with the first loop circumscribing the second and third loops, a first excitation circuit for generating an alternating current in the first loop, only during a first sequence of time intervals, and a second excitation circuit for generating respective alternating currents in the second and third loops, only during a second sequence of time intervals interleaved with the first sequence of time intervals, with the respective alternating currents in the second and third loops being about 180° out of phase with each other.

According to still a further aspect of the invention, there is provided an antenna arrangement for use with an EAS system, including first, second and third co-planar loops, a first excitation circuit for generating an alternating current in the first loop, only during a first sequence of time intervals, and a second excitation circuit for generating respective alternating currents in the second and third loops, only during a second sequence of time intervals interleaved with the first sequence of time intervals, with the respective alternating currents in the second and third loops being about 180° out of phase with each other, and the antenna arrangement having no other antenna loops that are co-planar with the first, second and third loops.

According to yet another aspect of the invention, there is provided an antenna arrangement for use with an EAS system, including first and second co-planar loops, a first excitation circuit for generating an alternating current in the first loop, only during a first sequence of time intervals, and a second excitation circuit for generating an alternating current in the second loop, only during a second sequence of time intervals interleaved with the first sequence of time intervals, with the first loop being substantially triangular. As alternatives to the just-mentioned aspect of the invention, the first loop may have an area that is substantially larger than an area of the second loop, and the first and second loops may be arranged in a plane that is vertically oriented.

According to still another aspect of the invention, there is provided an antenna arrangement for use with an EAS system, including a first planar loop arranged in a first plane, a second planar loop arranged in a second plane that intersects the first plane at an angle $\theta$, with $0°<\theta<180°$, a first excitation circuit for generating an alternating current in the first loop, only during a first sequence of time intervals, and a second excitation circuit for generating an alternating current in the second loop, only during a second sequence of time intervals interleaved with the first sequence of time intervals.

According to still a further aspect of the invention, there is provided an apparatus for receiving a signal present in an interrogation zone of an electronic article surveillance system, with such signal alternating at a predetermined frequency, and the apparatus including a first receiver coil for receiving the signal and providing a first received signal that alternates at the predetermined frequency, a second receiver coil adjacent to the first receiver coil for receiving the signal present in the interrogation zone and providing a second received signal which alternates at the predetermined frequency, a receive circuit, and a switchable connection circuit interconnecting the first and second receiver coil and the receive circuit and including switch means for switching the connection circuit between a first condition in which the connection circuit supplies the first and second received signals to the receive circuit with the first and second received signals in phase with each other and a second condition in which the connection circuit supplies the first and second received signals to the receive circuit with a phase offset of about 180° between the first and second received signals.

Further in accordance with the latter aspect of the invention, the connection circuit may include a summation circuit for receiving and summing the first and second received signals to produce a sum signal and for outputting the sum signal to the receive circuit, and a switchable shift circuit, connected between the second receiver coil and the summation circuit, for selectively phase-shifting the second received signal by about 180°. Further, the connection circuit may be maintained in the first condition during a first sequence of time intervals and maintained in the second condition during a second sequence of time intervals interleaved with the first sequence of time intervals. In addition, the first receiver coil may include a first segment and the second receiver coil may include a second segment arranged substantially in parallel and in proximity with the first segment, with the first and second receiver coils not having any other pair of segments arranged in parallel and in proximity with each other. In addition, the apparatus may be provided such that it has no other receiver coils in addition to the aforesaid first and second receiver coils.

The foregoing and other objects, features and advantages of the invention will be further understood from the following detailed description of preferred embodiments and from the drawings, wherein like reference numerals identify like components and parts throughout.

BRIEF DESCRIPTION OF THE DRAWINGS

FIG. 5C is also used to explain the field distribution provided by the antenna configuration of FIG. 2.

DESCRIPTION OF PREFERRED EMBODIMENTS

Figure 2:
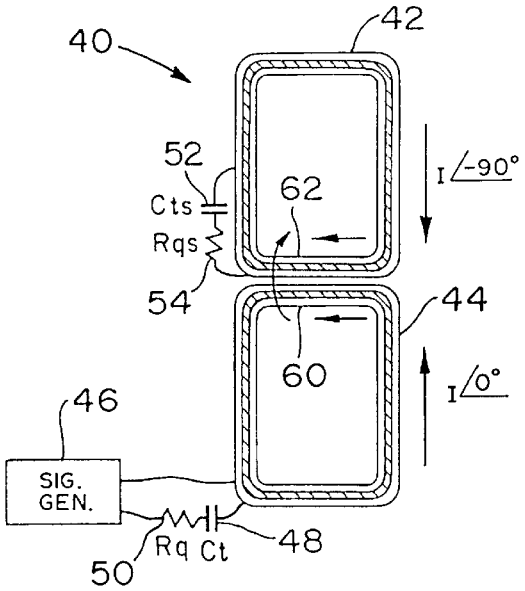
FIG. 2 schematically illustrates an antenna configuration provided for generating an interrogation field in accordance with a first embodiment of the invention.

An antenna configuration for generating an interrogation field and provided in accordance with a first embodiment of the invention will now be described with reference to FIG. 2. In FIG. 2 reference numeral 40 generally indicates the antenna configuration, which includes two co-planar antenna loops 42 and 44. The loops may, for example, both be rectangular and of like shape and size, and arranged, as shown in FIG. 2, with one loop stacked vertically above the other. Signal generating circuitry 46 is connected to the antenna loop 44 to directly generate an alternating current in the loop 44.

A capacitance 48 and resistance 50 are provided in series with the antenna loop 44 and a capacitance 52 and resistance 54 are provided in series with the antenna loop 42.

Figure 3:
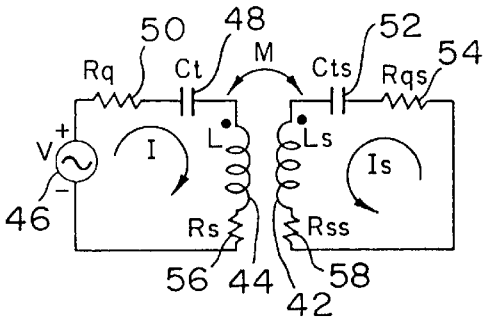
FIG. 3 is a circuit diagram of an equivalent circuit representative of the antenna configuration of FIG. 2.

FIG. 3 is an equivalent circuit representation of the arrangement of FIG. 2. In addition to the elements described in connection with FIG. 2, FIG. 3 also shows a loop resistance 56 provided by loop 44 and a loop resistance 58 provided by loop 42.

As shown in FIGS. 2 and 3, the antenna loops 42 and 44 are arranged so that there is substantial inductive coupling between the two loops, so that the alternating, current directly generated in loop 44 by the signal generator 46 inductively generates an alternating current in loop 42 that is 90° out of phase with the current in loop 44. For example, as shown in FIG. 2, a horizontal upper segment 60 of the loop 44 is parallel and adjacent to the lower horizontal segment 62 of loop 42.

Figure 1:
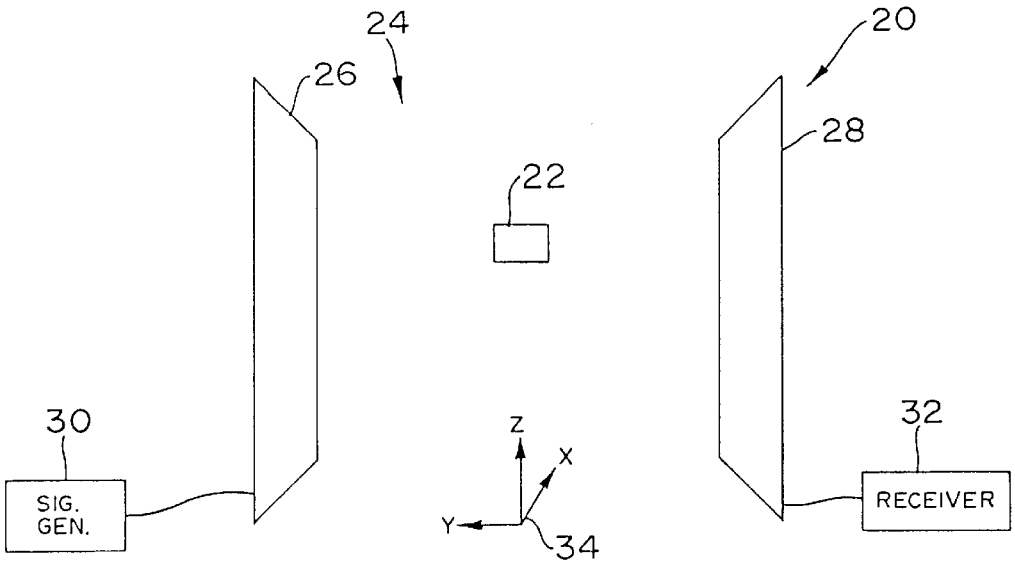
FIG. 1 is a schematic illustration of an electronic article surveillance system.
Figure 5A:
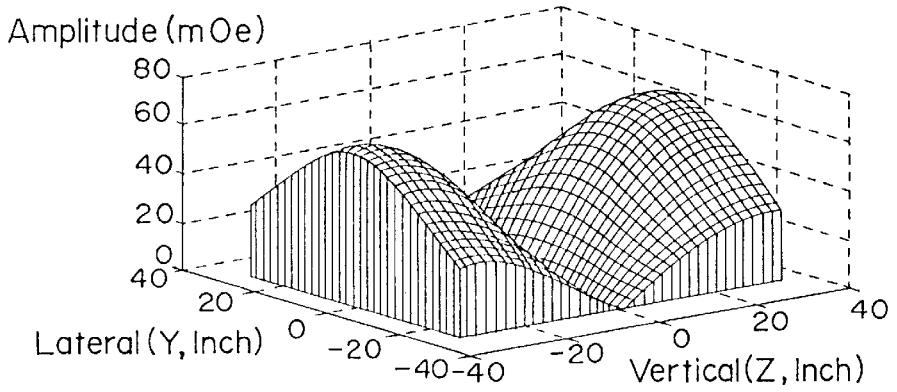
FIGS. 5A, 5B and 5C are used to explain the field distribution provided by the antenna configuration of FIG. 4.
Figure 5B:
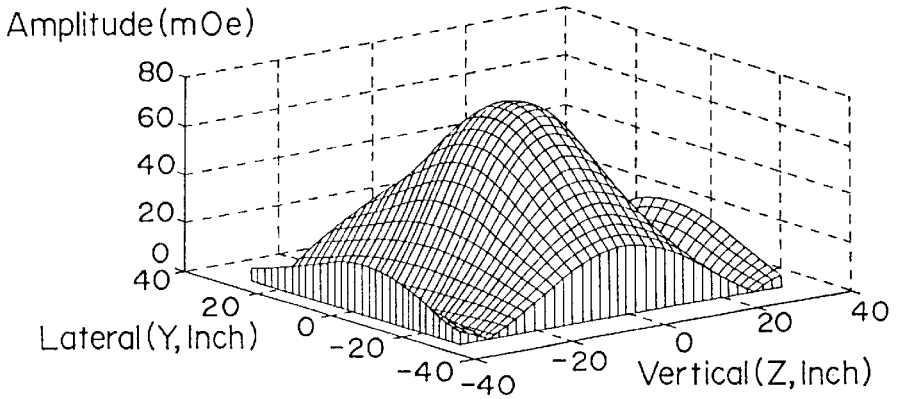
Figure 5C:
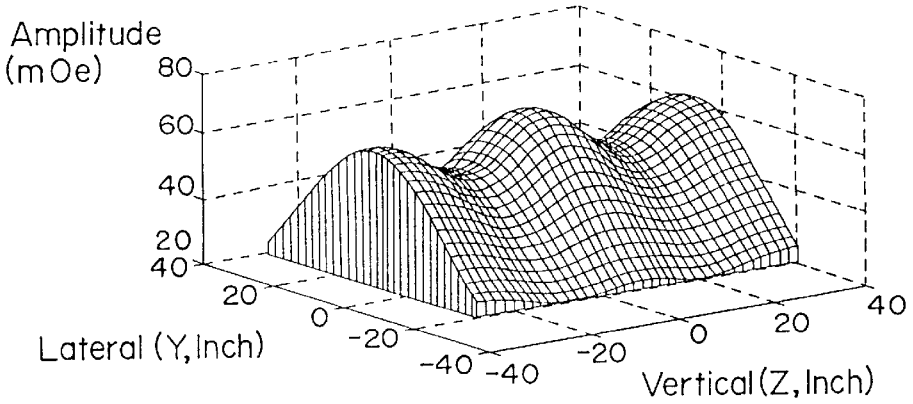

FIG. 5C illustrates an interrogation signal field distribution provided by the antenna arrangement of FIG. 2. The wire mesh graph surface shown in FIG. 5C represents the maximum effective signal amplitude received during an interrogation signal cycle by a marker receiving element that is in the above-mentioned vertical orientation. It will be noted that the graph surface is presented as a function of location in both the Y and Z directions (referring to FIG. 1). These values are representative of amplitudes experienced at a X-axis position that is in a central part of the interrogation zone.

Because of the quadrature relationship between the signals generated through the loops 42 and 44, it will be noted that there are no substantial nulls or holes in the field distribution.

Although this desirable field distribution can be conveniently provided by actively driving one loop and inductively coupling a second loop so that there is a quadrature relationship between the respective loop signals, it is also contemplated to provide separate signal generators for each of the loops and to directly drive the loops in quadrature relation.

Dual-Plane Quadrature Antenna

An antenna configuration 63 provided in accordance with a second embodiment of the invention is illustrated in FIG.

4. The antenna configuration 63 includes an antenna housing 64, shown in phantom, within which are housed antenna loops 66, 68, and 70. A signal generating circuit 72 is connected to the antenna loop 66 to generate an alternating current in the loop 66. A signal generating circuit 74 is connected to the loop 68 to generate in the loop 68 an alternating current at the same frequency as the current in loop 66, but 90° out of phase with the current in loop 66. Also, a signal generating circuit 76 is connected to the loop 70 to generate in the loop 70 an alternating current at the same frequency as, but 180° out of phase with, the alternating current in loop 68.

The antenna loop 66 is substantially rectangular and planar, and the loops 68 and 70 are substantially co-planar with each other. The plane of the antenna loop 66 is substantially parallel to the common plane of loops 68 and 70. (It will be noted that, for convenience in representation, the antenna configuration 63, has been inflated in a direction normal to the planes of the antenna loops.) The respective planes of loop 66 on one hand and of the loops 68 and 70 on the other are preferably provided quite close to each other. Each of the loops 68 and 70 is substantially as wide as the loop 66, but only half as high as the loop 66. The combined area of the loops 68 and 70 is preferably about equal to the area of loop 66. The loops 68 and 70 are preferably stacked one on top of the other in their respective plane. The loop 66 and the combination of loops 68 and 70 are horizontally aligned in the direction normal to their planes so that the loop 66 substantially overlaps with the combination of the loops 68 and 70 in the direction normal to the planes of the antenna loops. By overlapping in this direction, it should be understood that lines extending in the direction normal to the planes of the antenna loops intersect the respective plane segments defined by the antenna loops. The loop 66 is substantially entirely overlapping, in the direction normal to its plane, with the combination of loops 68 and 70 in the sense that substantially all of the area of the loop 66 overlaps in that direction with the combination of loops 68 and 70.

FIGS. 5A and 5B are graphs similar to the above-discussed FIG. 5C, but respectively represent field components provided by the antenna loop 66 (FIG. 5A) and the combination of loops 68 and 70 (FIG. 5B). The graph shown in FIG. 5C represents the combination of the fields provided by all three loops and, as noted before, does not have significant nulls or holes.

Figure 6:
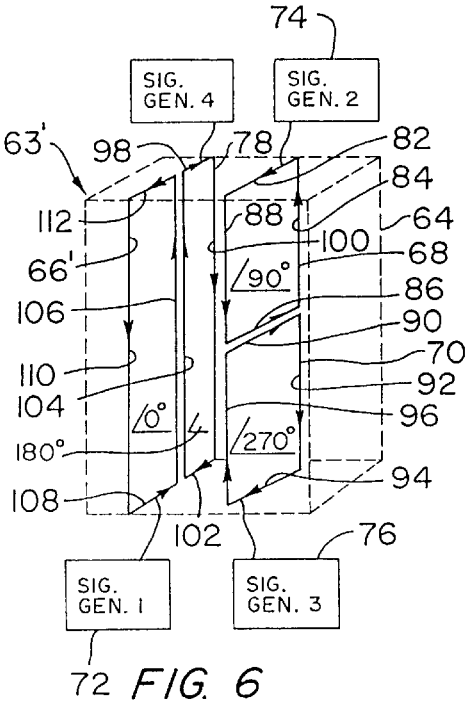
FIG. 6 illustrates an antenna configuration provided for generating an interrogation field in accordance with a third embodiment of the invention.

An antenna configuration 63' according to a third embodiment of the invention is illustrated in FIG. 6.

Figure 4:
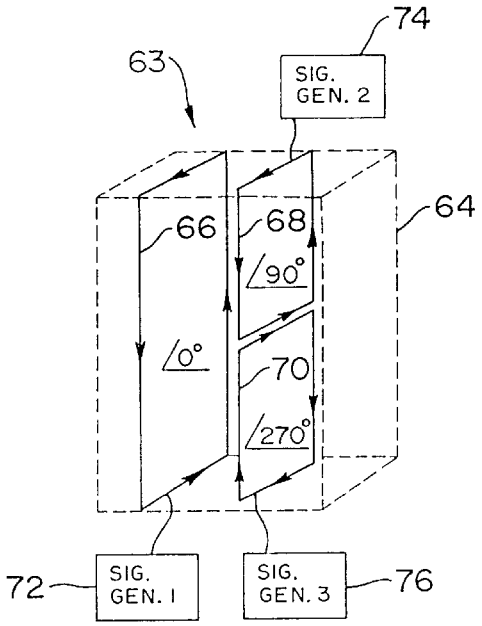
FIG. 4 illustrates an antenna configuration provided for generating an interrogation field in accordance with a second embodiment of the invention.

The antenna configuration 63' is the same as the configuration 63 of FIG. 4, except that the single loop 66 of FIG. 4 is replaced by side-by-side rectangular co-planar loops 66' and 78. The loop 66' is driven by the previously described signal generating circuit 72, and an additional signal generating circuit 80 is connected to loop 78 to generate an alternating current in loop 78 that is at the same frequency but 180° out of phase with the current in loop 66'. The antenna configuration 63' of FIG. 6 provides a relatively even field distribution in the interrogation zone, like that provided by the antenna configuration of FIG. 4, while providing the additional feature of far-field cancellation by virtue of the two pairs of "bucking" loops 63' and 78, and 68 and 70.

As shown in FIG. 6, loop 68 includes a horizontal segment 82, a vertical segment 84 extending downwardly vertically from a right end of segment 82, a horizontal segment 86 extending leftwardly and horizontally from a lower end of the segment 84, and a vertical segment 88 which extends vertically to interconnect the respective left ends of segments 82 and 86.

Loop 70 includes a horizontal segment 90 that extends horizontally in parallel and in proximity to the segment 86 of loop 68. Loop 70 also includes a segment 92 that extends downwardly vertically from a right end of segment 90, a segment 94 which extends leftwardly and horizontally from a lower end of segment 92, and a segment 96 which extends vertically to interconnect the respective left ends of segments 90 and 94.

Loop 78 includes a top horizontal segment 98, a segment 100 that extends downwardly vertically from a right end of the segment 98, a segment 102 that extends leftwardly and horizontally from a lower end of the segment 100, and a segment 104 that extends vertically to interconnect the respective left ends of the segments 98 and 102.

Loop 66' includes a segment 106 that extends vertically in parallel and in proximity to the segment 104 of loops 78. Loop 66' also includes a segment 108 that extends leftwardly and horizontally from a lower end of segment 106, a segment 110 that extends vertically upwardly from a left end of the segment 108, and a segment 112 that extends horizontally to interconnect the respective upper ends of the segments 106 and 110.

Further, each of the segments 82, 86, 90 and 94 are substantially equal in length (loops 68 and 70 being equally wide) and each of the horizontal segments 98, 102, 108 and 112 are equal to each other in length and have a length that is substantially one-half the length of segments 82, 86, 90 and 94 (the loops 66' and 78 being equal in width to each other and having half the width of the loops 68 and 70).

The vertical segments 100, 104, 106, and 110 are all equal to each other in length (the loops 66' and 78 being equal in height), and the vertical segments 84, 88, 92 and 96 are all substantially equal in length to each other and have a length that is substantially one-half of the length of the segments 100, 104, 106 and 110 (loops 68 and 70 being equal in height to each other and having one-half the height of the loops 66' and 78).

Also, loop segment 92 is substantially vertically aligned with loop segment 84, loop segment 96 is substantially vertically aligned with loop segment 88, loop segment 112 is substantially horizontally aligned with loop segment 98 and loop segment 108 is substantially horizontally aligned with loop segment 102.

Dual-Plane Far-Field Cancelling Antenna

Figure 7:
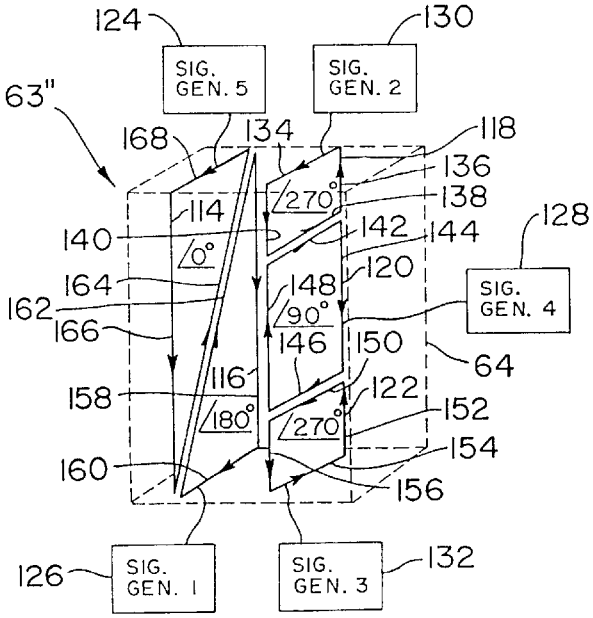
FIG. 7 illustrates an antenna configuration provided for generating an interrogation field in accordance with a fourth embodiment of the invention.

An antenna configuration 63" provided in accordance with a fourth embodiment of the invention is shown in FIG. 7. The antenna configuration 63" differs from the configuration 63 of FIG. 4 in that the loop 66 of FIG. 4 is replaced in the configuration of FIG. 7 with two co-planar triangular antenna loops 114 and 116. Also, the loops 68 and 70 of FIG. 4 are replaced in the configuration of FIG. 7 with three stacked co-planar rectangular loops 118, 120 and 122.

A signal generating circuit 124 is connected to loop 114 to generate an alternating current in loop 114. A signal generating circuit 126 is connected to loop 116 to generate an alternating current in loop 116 that is the same in frequency as the current in loop 114 but 180° out of phase. A signal generating circuit 128 is connected to loop 120 to generate in loop 120 an alternating current that is of the same frequency but 90° out of phase with the current in loop 114. A signal generating circuit 130 is connected to loop 118 to generate in loop 118 an alternating current that is of the same frequency but 180° out of phase with the current in loop 120.

A signal generating circuit 132 (which may be combined with signal generating circuit 130) is connected to loop 122 and generates in loop 122 an alternating current that is the same in frequency and is in phase with the current in loop 118.

It should also be understood that the combined area of loops 114 and 116 is substantially equal to the combined area of loops 118, 120 and 122.

The "bucking" pair of triangular co-planar loops 114 and 116 are of substantially equal areas. Also, the loop 120 has substantially the same area as the combined areas of the loops 118 and 122, which generate a signal 180° out of phase with the signal of loop 120. As a consequence, the antenna configuration 63" of FIG. 7, like the configuration of FIG. 6, provides both a relatively even field distribution in the interrogation zone as well as far-field cancellation.

As shown in FIG. 7, loop 118 includes a top horizontal segment 134, a segment 136 which extends downwardly vertically from a right end of segment 134, a segment 138 that extends leftwardly and horizontally from a lower end of the segment 136, and a segment 140 that extends vertically to interconnect the respective left ends of segments 134 and 138.

Loop 120 includes a top segment 142 that extends horizontally in parallel and in proximity to the segment 138 of loop 118. In addition, the loop 120 includes a segment 144 that extends downwardly vertically from a right end of the segment 142, a segment 146 that extends leftwardly and horizontally from a lower end of the segment 144, and a segment 148 that extends vertically to interconnect the respective left ends of segments 142 and 146.

Loop 122 includes a top segment 150 that extends horizontally in parallel and in proximity to the segment 146 of loop 120. Also, loop 122 includes a segment 152 which extends downwardly vertically from a right end of the segment 150, a segment 154 that extends leftwardly and horizontally from a lower end of the segment 152 and a segment 156 that extends vertically to interconnect the respective left ends of the segments 150 and 154.

The antenna loop 116 includes a segment 158 that extends vertically, a segment 160 that extends horizontally leftwardly from a lower end of the segment 158, and a segment 162 that extends obliquely to interconnect a left end of the segment 160 and an upper end of the segment 158.

The loop 114 includes a segment 164 that extends obliquely and in parallel and in proximity to the segment 162 of loop 116. The segment 114 also includes a segment 166 that extends vertically upwardly from a lower end of the segment 164 and a segment 168 that extends horizontally to connect the respective upper ends of the segments 164 and 168.

Further, the horizontal segments 134, 138, 142, 146, 150 and 154 are all substantially equal in length; the vertical segments 136, 140, 152 and 156 are all substantially equal in length to each other; the vertical segments 144 and 148 are substantially equal in length to each, each being twice the length of the segments 136, 140, 152 and 156; and the vertical segments 158 and 166 are substantially equal in length to each other, each being twice as long as the segments 144 and 148.

Also, the segments 136, 144 and 152 are all substantially in vertical alignment with each other; and the segments 140, 148 and 156 are all substantially in vertical alignment with each other.

A modification of the embodiment of FIG. 7, which does not provide far-field cancellation, should also be noted. In particular, an antenna configuration may be provided which includes only the co-planar triangular loops 114 and 116, but with respective signal generators, or inductively coupled as in the embodiment of FIG. 2, such that the respective currents in loops 114 and 116 are 90° out of phase.

Co-Planar Far-Field Cancelling Antennas

Figure 8:
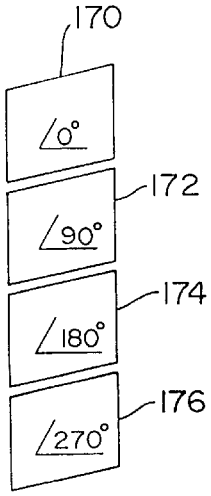
FIG. 8 illustrates a conventional antenna configuration.

FIG. 8 shows a known antenna configuration made up of four stacked, rectangular co-planar loops 170, 172, 174 and 176. As indicated in FIG. 8, loop 172 transmits a signal that is 90° out of phase with the signal provided by loop 170; loop 174 provides a signal that is 180° out of phase with the signal of loop 170; and loop 176 provides a signal that is 180° out of phase with the signal of loop 172.

It is common to employ rectangular loop antennas disposed in a vertically oriented plane (i.e. in the orientation referred to as "lateral" in a prior discussion of plane orientations herein) because the vertical segments of the rectangular loops provide horizontal and lateral fields (i.e. fields for stimulating markers in the horizontal and lateral orientations, respectively), while the horizontal segments of the loops provide horizontal and vertical fields (i.e. fields for interrogating markers in the horizontal and vertical orientations, respectively).

Figure 14A:
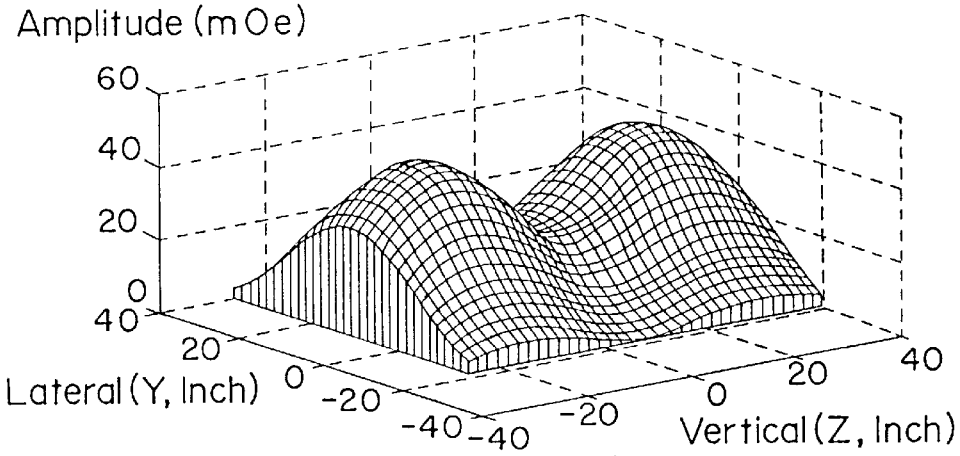
FIGS. 14A–14C are used to illustrate a field distribution generated by the conventional antenna configuration of FIG. 8.
Figure 14B:
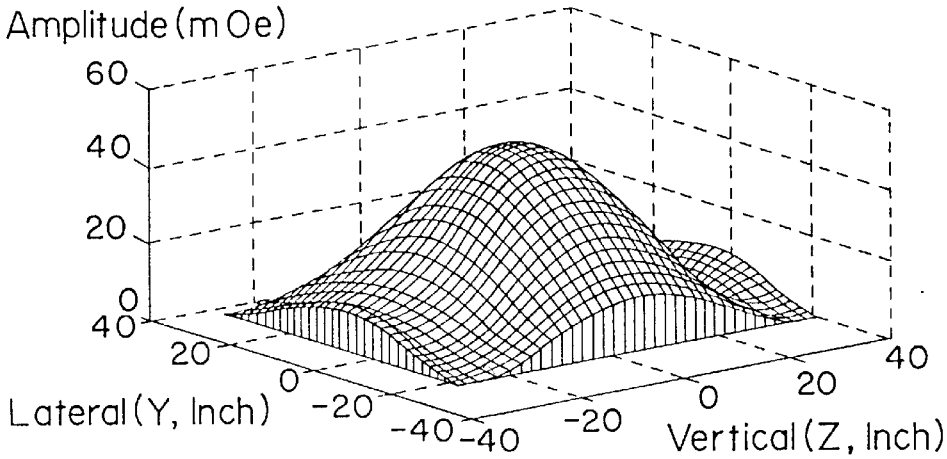

It will also be noted that the arrangement of FIG. 8 tends to produce far-field cancellation. However, the "bucking" relationship between the corresponding vertical segments of loops 170 and 174, and between the corresponding vertical segments of loops 172 and 176, also tends to result in some near-field cancellation, producing holes in the interrogation field within the desired interrogation zone. The horizontal, vertical and lateral fields provided by the antenna arrangement of FIG. 8 are respectively illustrated in FIGS. 14A, 14B and 14C. It will be noted that the horizontal field (FIG. 14A) is particularly low in amplitude for Z=0 and Y=±20, while the lateral field (FIG. 14C) is low in amplitude for Y=0 and is also fairly low for Z=0.

Figure 9:
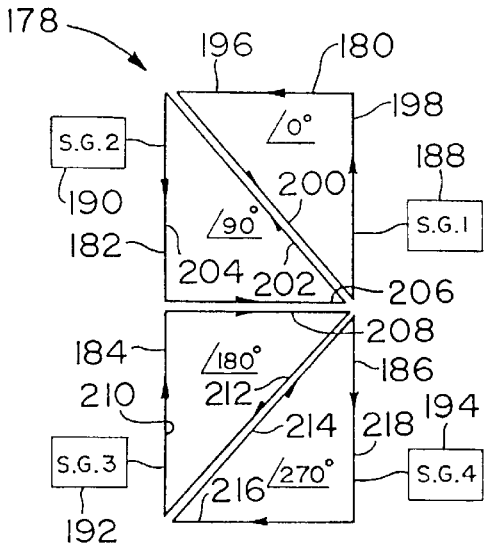
FIG. 9 illustrates an antenna configuration provided for generating an interrogation field in accordance with a fifth embodiment of the invention.

FIG. 9 illustrates an antenna configuration 178 according to a fifth embodiment of the invention. As will be seen, the configuration shown in FIG. 9 is formed entirely of co-planar loops and provides a more uniform field distribution than the arrangement of FIG. 8.

The antenna configuration 178 includes co-planar triangular loops 180, 182, 184 and 186 and signal generating circuits 188, 190, 192 and 194 respectively connected to the loops 180, 182, 184 and 186. As shown in FIG. 9, the alternating current generated in loop 182 is 90° out of phase with the alternating current generated in loop 180. Also, the alternating current generated in loop 184 is 180° out of phase with the current in loop 180, and the current generated in loop 186 is 180° out of phase with the current generated in loop 182.

It is to be noted that, in the arrangement of FIG. 9, there are no vertically aligned pairs of bucking vertical segments. Rather, in each pair of vertically aligned vertical segments, the respective signals provided by the two segments of the pair are 90° out of phase. As a consequence, the arrangement shown in FIG. 9 provides far-field cancellation while also substantially improving the evenness of the field distribution in the interrogation zone as compared with the arrangement of FIG. 8.

Figure 13A:
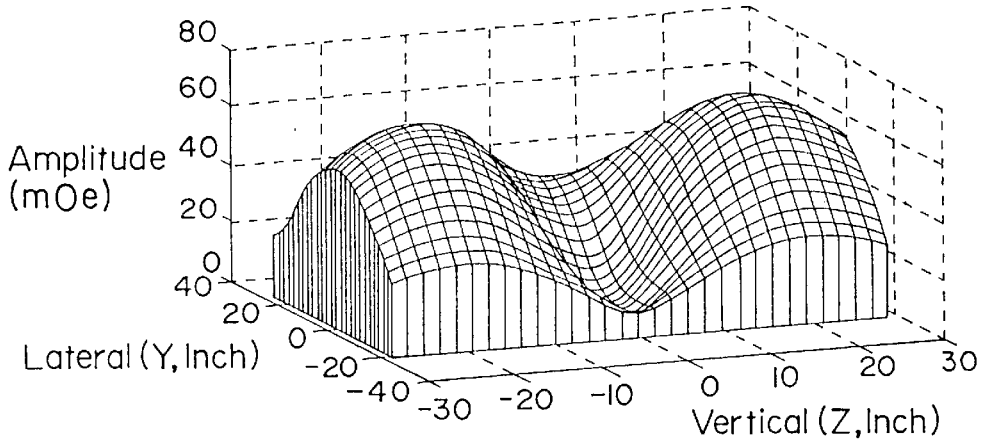
FIGS. 13A–13C are used to explain a field distribution generated by the antenna configuration of FIG. 9.
Figure 13B:
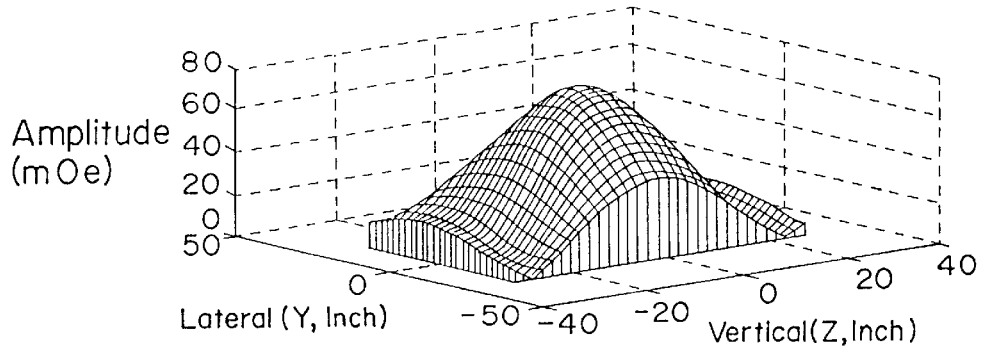
Figure 13C:
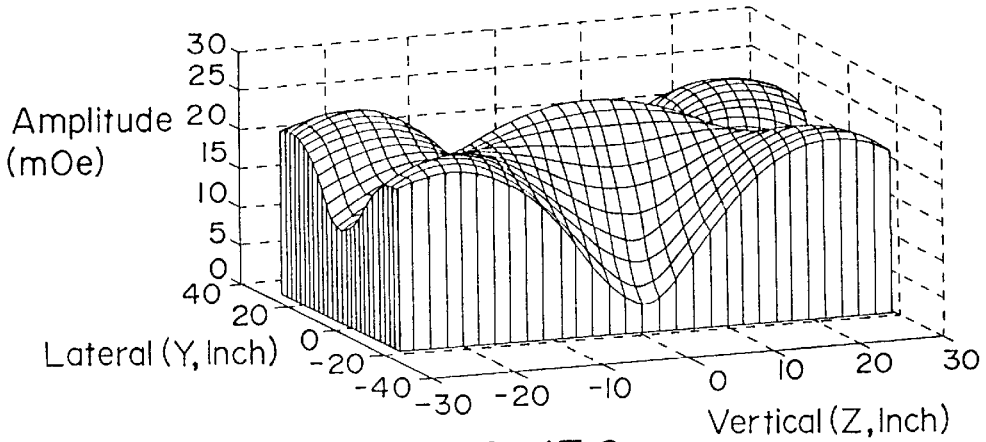

The horizontal, vertical and lateral fields provided by the arrangement of FIG. 9 are respectively illustrated by the graphs of FIGS. 13A, 13B, and 13C. Comparing, for example, FIG. 13A with FIG. 14A, a considerable improvement in peak amplitude for Z=0 is provided in the field shown in FIG. 13A.

Figure 14C:
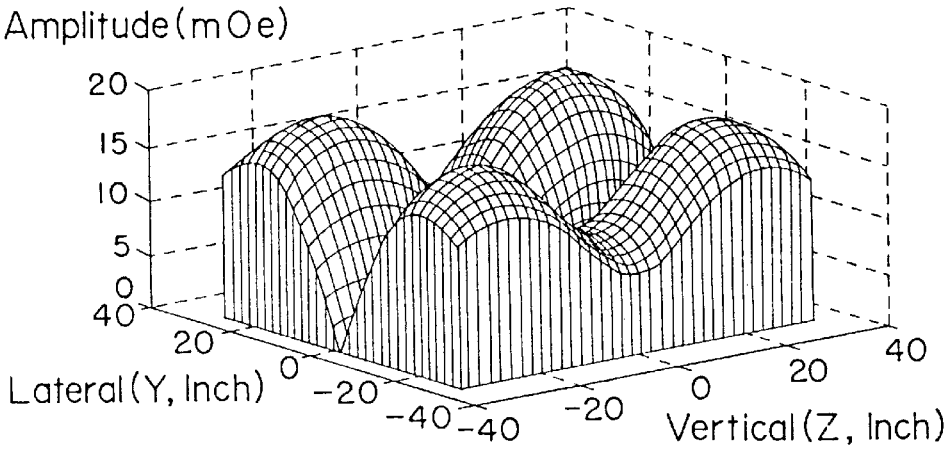

There is an even more notable plugging of holes with respect to the lateral field, as is seen by comparing FIG. 13C with FIG. 14C. In particular, the field shown in FIG. 13C exhibits a very robust improvement for Y=0 as compared to the field shown in FIG. 14C.

As shown in FIG. 9, loop 180 includes a top horizontal segment 196, a segment 198 that extends downwardly vertically from a right end of the segment 196, and a segment 200 that extends obliquely to interconnect a lower end of the segment 198 and a left end of the segment 196.

The loop 182 includes a segment 202 which extends obliquely in parallel and in proximity to the segment 200 of loop 180. In addition, the loop 182 includes a segment 204 that extends vertically downwardly from an upper end of the segment 202, and a segment 206 that extends horizontally to interconnect the respective lower ends of the segments 204 and 202.

The loop 184 includes a segment 208 which extends horizontally in parallel and in proximity to the segment 206 of loop 182. In addition, loop 184 includes a segment 210 that is vertically aligned with the segment 204 of loop 182 and extends downwardly vertically from a left end of the segment 208. Finally, loop 184 includes a segment 212 that extends obliquely to interconnect a lower end of the segment 210 and a right end of the segment 208.

Loop 186 includes a segment 214 which obliquely extends in parallel and in proximity to the segment 212 of loop 184. Also, the loop 186 includes a segment 216 which extends horizontally rightwardly from a lower end of the segment 214 and a segment 218 vertically aligned with the segment 198 of loop 180 and extending vertically to interconnect the respective right ends of the segments 214 and 216.

Further, each of the segments 196, 206, 208 and 216 are substantially equal in length; and the segments 198, 204, 210 and 218 are all substantially equal in length to each other. In addition, the oblique segments 200, 202, 212 and 214 are all substantially equal in length to each other.

Figure 10:
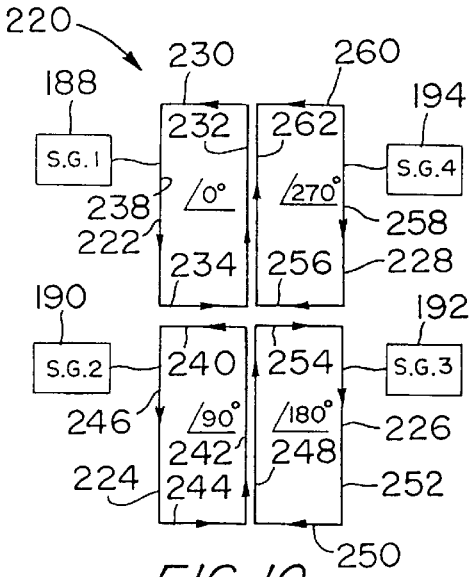
FIG. 10 illustrates an antenna configuration provided for generating an interrogation field in accordance with a sixth embodiment of the invention.

An antenna configuration 220 provided in accordance with a sixth embodiment of the invention is shown in FIG. 10. The antenna configuration 220 employs four rectangular co-planar loops 222, 224, 226 and 228. As in Fig. 9, signal generating circuits 188, 190, 192 and 194 are respectively connected to the loops 222, 224, 226 and 228 to drive the respective loops in the same phase relationship as was described in connection with the configuration of FIG. 9. As was the case in the configuration of FIG. 9, the configuration of FIG. 10 is arranged so that any two vertically aligned vertical segments are driven with a 90° phase relationship, with the result that no bucking vertical segments are vertically aligned with each other. The configuration of FIG. 10 provides far-field cancellation while also avoiding significant holes in the interrogation field provided in the interrogation zone.

As shown in FIG. 10, loop 222 includes a top horizontal segment 230, a segment 232 which extends downwardly vertically from a right end of the segment 230, a segment 234 which extends leftwardly and horizontally from a lower end of the segment 232, and a segment 238 which extends vertically to interconnect the respective left ends of the segments 230 and 234.

The loop 224 includes a segment 240 which extends horizontally in parallel and in proximity to the segment 234 of loop 222. In addition, loop 224 includes a segment 242 vertically aligned with the segment 232 of loop 222 and extending downwardly vertically from a right end of the segment 240. Further, loop 224 includes a segment 244 which extends leftwardly and horizontally from a lower end of the segment 242 and a segment 246 vertically aligned with the segment 238 of loop 222 and extending vertically to interconnect the respective left ends of the segments 240 and 244.

Loop 226 includes a segment 248 that extends vertically in parallel and in proximity to the segment 242 of loop 224. Loop 226 also includes a segment 250 that extends horizontally rightwardly from a lower end of the segment 248, a segment 252 that extends vertically upwardly from a right end of the segment 250, and segment 254 that extends horizontally to interconnect the respective upper ends of the segments 248 and 252. Segments 250 and 254 are respectively horizontally aligned with segments 244 and 240 of loop 224.

The loop 228 includes a segment 256 that extends horizontally in parallel and in proximity to the segment 254 of loop 226. The loop 228 also includes a segment 258 vertically aligned with the segment 252 of loop 226 and extending vertically upwardly from a right end of the segment 256. In addition, loop 228 includes a segment 260 which extends horizontally leftwardly from an upper end of the segment 258 and a segment 262 vertically aligned with the segment 248 of loop 226 and extending vertically to interconnect the respective left ends of segments 256 and 260. Segments 256 and 260 are respectively horizontally aligned with segments 234 and 230 of loop 222.

Further, the segments 230, 234, 240, 244, 250, 254, 256 and 260 are all substantially equal in length; and the segments 232, 238, 242, 246, 248, 252, 258 and 262 are all substantially equal in length to each other.

It will be observed that there are a number of pairs of vertical segments having currents that are in bucking relationship with each other, but in each case the two segments making up the pair of segments are horizontally displaced with respect to each other. For example, the segments 222 and 248 have respective currents that are in bucking relationship, but the segments 222 and 248 are displaced both horizontally and vertically with respect to each other. Such is also the case with respect to the pair of segments 258 and 242.

Figure 11:
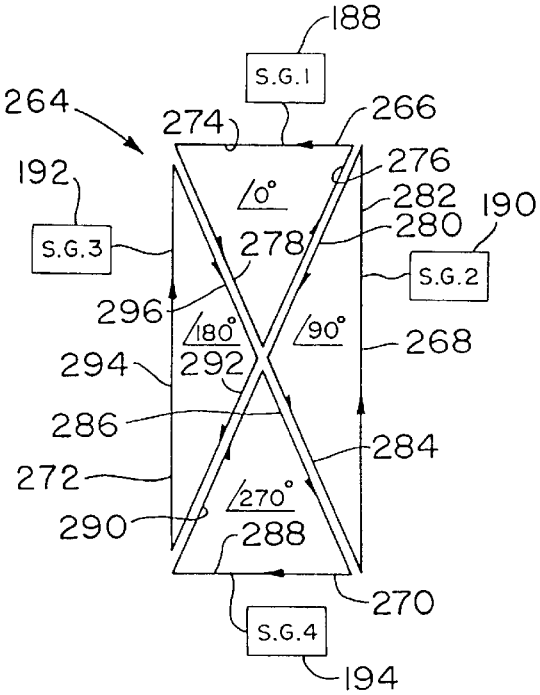
FIG. 11 illustrates an antenna configuration provided for generating an interrogation field in accordance with a seventh embodiment of the invention.

According to a seventh embodiment of the invention, shown in FIG. 11, there is provided an antenna configuration 264 in which the only two vertical segments are horizontally displaced with respect to each other. The antenna configuration 264 includes antenna loops 266, 268, 270 and 272. The loops 266–272 are all triangular and co-planar. Signal generating circuits 188, 190, 192 and 194 are respectively connected to loops 266, 268, 272 and 270. The loops 266, 268, 272 and 270 are driven by the respective generating circuits according to the phase relationship described in connection with FIG. 9 among loops 180, 182, 184 and 186.

As was the case with the embodiments of FIGS. 9 and 10, the antenna configuration 264 of FIG. 11 provides far-field cancellation while generating an interrogation field that does not have significant holes in the interrogation zone. Again, it is significant that there are no vertically aligned vertical segments in bucking relation to each other. In fact, as noted above, the only two vertical segments are not vertically aligned with each other.

As shown in FIG. 11, loop 266 includes a horizontal segment 274, a segment 276 which extends obliquely downwardly and leftwardly from a right end of the segment 274 and has a lower end that is displaced vertically downwardly from the midpoint of the segment 274. The loop 266 also includes a segment 278 that extends obliquely to interconnect the lower end of the segment 276 and a left end of the segment 274.

The loop 268 includes a segment 280 that extends obliquely in parallel and in proximity to the segment 276, a segment 282 that extends vertically downwardly from an upper end of the segment 280 and a segment 284 that is substantially aligned with segment 278 of loop 266 and extends obliquely to interconnect the respective lower ends of the segments 280 and 282.

Loop 270 includes a segment 286 that extends obliquely in parallel and in proximity to the segment 284, a segment 288 that extends horizontally leftwardly from a lower end of the segment 286, and a segment 290 that is substantially aligned with the segment 280 of loop 268 and extends obliquely to interconnect the respective left ends of the segments 286 and 288.

Loop 272 includes a segment 292 that is substantially aligned with the segment 276 of loop 266 and extends obliquely in parallel and in proximity to the segment 290 of loop 270. In addition, the loop 272 incudes a segment 294 that extends vertically upwardly from a lower end of the segment 292 and also a segment 296 that is substantially aligned with the segment 286 of loop 270 and extends obliquely in parallel and in proximity to the segment 278 of loop 266 to interconnect the respective upper ends of segments 294 and 292.

The segments 274 and 288 are substantially equal in length, the segments 282 and 294 are substantially equal in length to each other, and the segments 276, 278, 280, 284, 286, 290, 292 and 296 are all substantially equal in length to each other.

Figure 12:
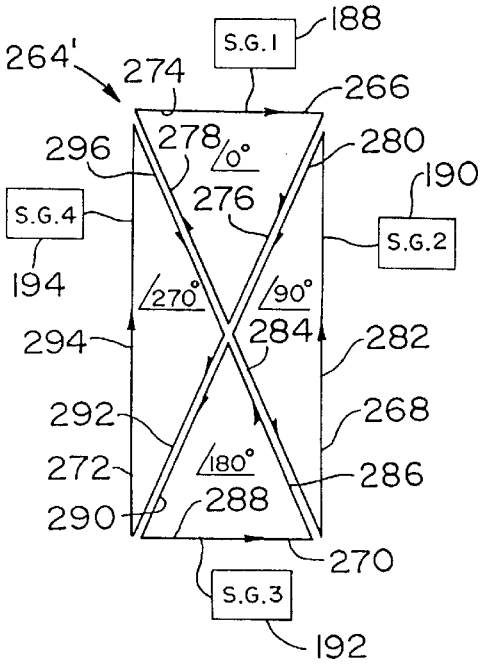
FIG. 12 illustrates an antenna configuration provided for generating an interrogation field in accordance with an eighth embodiment of the invention.

An antenna configuration 264' provided in accordance with an eighth embodiment of the invention is shown in FIG. 12. The antenna configuration 264' is the same as the configuration 274 of FIG. 11 except for the phase relationship among the respective alternating currents in the antenna loops 266, 268, 270 and 272.

In particular, in the configuration 264' of FIG. 12, the current in loop 270 is 180° out of phase with the current in loop 266 and the current in loop 272 is 180° out of phase with the current in loop 268. By contrast, in the antenna configuration 264 of FIG. 11, the current in loop 270 is 180° out of phase with the current in loop 268 and the current in loop 272 is 180° out of phase with the current in loop 266. It should be noted that, in both embodiments, the current in loop 268 is 90° out of phase with the current in loop 266.

Like the embodiment of FIG. 11, the embodiment of FIG. 12 provides a relatively even field distribution within the interrogation zone and also provides far-field cancellation.

Quadrature Receiver Arrangement

A receiver portion of an electronic article surveillance system, provided according to a ninth embodiment of the invention, will now be described with reference to FIGS. 15 and 16. The receiver portion, generally indicated by reference numeral 300, includes two antenna loops 302, 304, which are preferably rectangular, stacked, co-planar antenna loops. The respective signals received through the antenna loops 302 and 304 are coupled to a receiver circuit 306.

To avoid nulls in the interrogation zone, it is desirable that the respective signals received through the antenna loops 302 and 304 be presented to the receiver circuit 306 in a quadrature relationship. FIG. 16 illustrates a preferred circuit arrangement for providing such a relationship.

Figure 16:
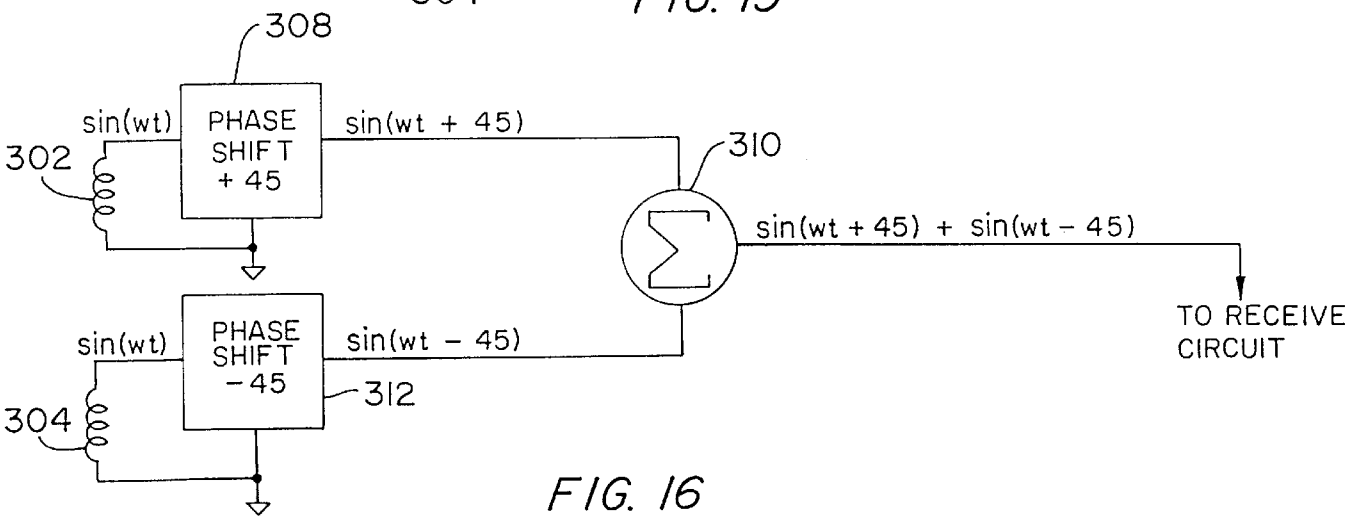
FIG. 16 illustrates certain features of the receiver antenna configuration of FIG. 15.

As shown in FIG. 16, the signals received via the antenna loop 302 are phase shifted by +45° in a phase shift circuit 308, and the resulting phase-shifted signal is provided to an input of a summation circuit 310. Also, the signal received through the antenna loop 304 is phase-shifted by −45° in a phase shift circuit 312 and the resulting phase-shifted signal is provided to the other input of the summation circuit 310. The two phase-shifted signals are summed at the summation circuit 310 and the resulting summed signal is provided to receiver circuitry (not shown) for further processing.

According to a preferred embodiment of the invention, the phase shift circuit 308 may be a low-pass filter having its 3-dB point at 58 kHz, and the phase shift circuit 312 may be a high pass filter with its 3-dB point at 58 kHz. The phase splitting could also be performed using appropriate LC circuitry or active filters.

It should also be noted that one of the phase shift circuits could be arranged to provide a 90° phase shift, in which case the other phase shift circuit would be omitted.

The combined 90°-offset signals provide an interplay between the signals received by the two antenna loops which is helpful in detecting marker signals. This provides advantages as compared to a previous known technique in which the respective antenna signals were analyzed in separate time slots, since the latter technique results in nulls in the interrogation zone.

It is also contemplated to achieve the desired quadrature relationship by providing inductive coupling between the two antenna loops in a similar manner to that shown in the embodiment of FIG. 2. However, this is not preferred because adequate inductive coupling between the antenna loops requires that the loops be arranged with high Q, which tends to result in excessive ringing in pulsed magnetomechanical EAS systems. On the other hand, with the arrangement shown in FIG. 16, the Q of the antenna loops can be moderated so as to prevent ringing.

Figure 15:
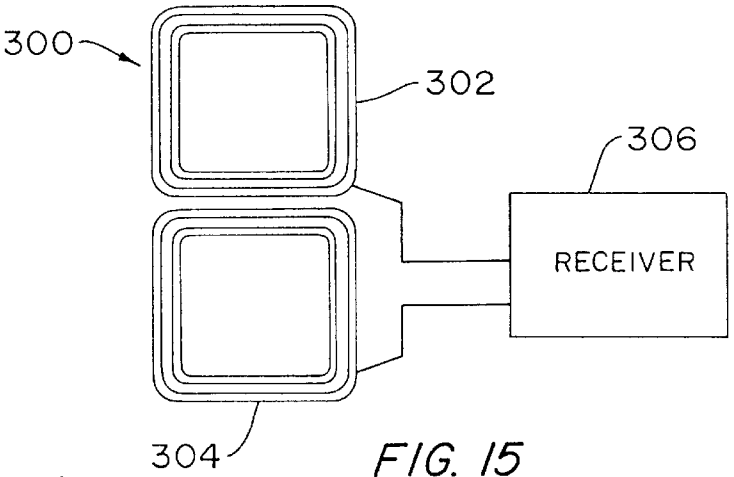
FIG. 15 schematically illustrates an antenna configuration used for receiving a marker signal in accordance with a ninth embodiment of the invention.

Although not shown in FIGS. 15 and 16, it should be understood that the quadrature receiver arrangement of FIG. 16 can be adapted to a far-field cancelling antenna configuration.

It should further be understood that antenna arrangements shown in this application in which respective signal generators are provided for every antenna loop (see, for example, FIGS. 9 and 10) can be modified by arranging two adjacent loops for inductive coupling with a 90° phase offset, as was described in connection with FIGS. 2 and 3. Moreover, where two co-planar loops are provided with a 180° phase offset (as in FIGS. 4, 6, 9 and 10, for example) the two loops can be provided by a single twisted loop as shown in FIG. 3 of U.S. Pat. No. 4,245,980 or in U.S. Pat. No. 4,872,018.

Although no connection between signal generators is shown in the drawings (such as FIGS. 4 and 6) in which more than one signal generator is shown, it will be understood by those of ordinary skill in the art that control signals or a common reference signal may be provided to all of the signal generators in order to obtain the synchronization required for the desired phase relationships.

Further variations of the preferred embodiments already described are contemplated, including those that will now be described with reference to FIGS. 17–21.

Figure 17:
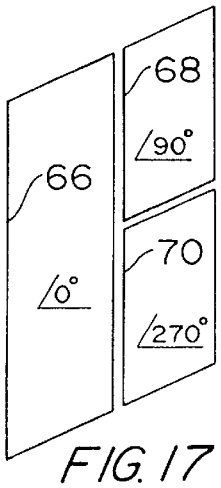
FIGS. 17–21 schematically illustrate various modifications that can be made to the embodiment of FIG. 4.
Figure 18:
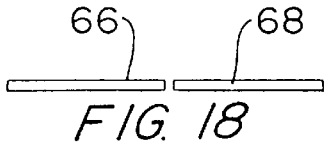

For example, the embodiment shown in FIG. 4 can be modified by making all three loops 66, 68 and 70 co-planar, with the stacked pair of bucking loops 68 and 70 arranged alongside loop 66. This arrangement is schematically illustrated in FIGS. 17 and 18, which are respectively a perspective view and a plan view of the arrangement. It will be noted that all of the loops 66, 68 and 70, are vertically oriented, i.e., are arranged in a plane that is orthogonal to a horizontal plane. Also, the loops 68 and 70 (represented by loop 68 in FIG. 18) are displaced in a horizontal direction relative to loop 66.

The arrangement shown in FIGS. 17 and 18 provides essentially the same result as the embodiment of FIG. 4, although with the disadvantage of having an antenna configuration that is substantially wider (longer in the X-axis direction—see FIG. 1) than the embodiment of FIG. 4. It will be understood that the respective fields (shown in FIGS. 5A and 5B) provided by loop 66 and the combination of loops 68 and 70 are not overlaid in space to produce the field (shown in FIG. 5C) that is provided by the embodiment of FIG. 4. However, a marker that is in a vertical orientation and is transported through the interrogation zone in the X-axis direction, and with little movement in the Y- and Z-axis directions, would sequentially experience the field profiles shown in FIG. 5A and 5B within a short period of time, resulting in an effective interrogation field that is equivalent to the field shown in FIG. 5C.

It should be observed that the modification made to the dual-plane embodiment shown in FIG. 4, which results in the arrangement of FIGS. 17 and 18, can also be made to the dual-plane embodiments shown in FIGS. 6 and 7.

Figure 19:
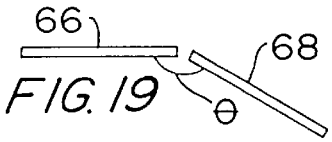

FIG. 19 schematically illustrates a further modification which can be made to the arrangement of FIGS. 17 and 18, while providing substantially the same results. As seen in FIG. 19, (which is a plan view similar to FIG. 18), the pair of co-planar bucking loops 68 and 70 (again represented in the drawing by loop 68) is shifted by a modest amount so as not to be co-planar with the loop 66. Rather, the loop 66 and the combination of loops 68 and 70 are arranged in respective planes that intersect at an angle θ, as shown in FIG. 19. So long as θ does not vary from 180° by more than about 20°, it is believed that the arrangement in FIG. 19 would produce substantially the same result as the arrangement of FIGS. 17 and 18. Of course, as θ is reduced from 180° towards 90°, the thickness of the antenna arrangement (i.e., its length in the Y-axis direction) would be increased.

Figure 20:
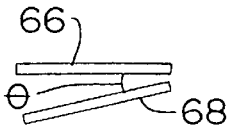

If the angle e is permitted to become a rather small acute angle, as schematically illustrated in FIG. 20, the arrangement approaches the dual-plane embodiment of FIG. 4. It is believed that, for values of e in the range of about 15° or less, essentially the same combined field is produced as the field shown in FIG. 5C.

Figure 21:
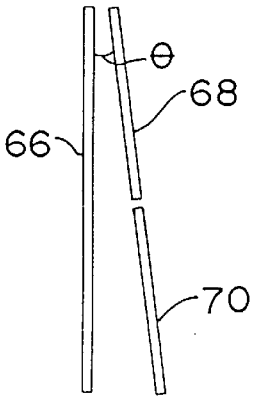

Another intersecting-plane antenna arrangement is schematically illustrated in FIG. 21, which is a side view of the arrangement. It will be observed that the co-planar combination of loops 68 and 70 is arranged in a plane that tilts relative to the plane of loop 66, with the two planes again intersecting at an angle θ. In this case, the loop 66 remains vertically oriented, but the loops 68 and 70 diverge from a vertical orientation. It is believed that satisfactory results can be obtained for values of θ of up to 90°, but it is contemplated to provide an arrangement with θ at any value in the range $0°<\theta<180°$. Again the intersecting plane arrangement tends to produce a somewhat less compact antenna configuration than a dual plane embodiment, as shown in FIG. 4.

It will be appreciated that the modifications illustrated in FIGS. 19–21 can also be applied to the dual-plane embodiments shown in FIGS. 6 and 7.

In connection with both transmitted and received signals, the embodiments described herein have been concerned with signals in quadrature relationship, i.e., with a 90° phase offset. However, it should be noted that satisfactory results can also be expected with a phase relationship that deviates from a 90° offset by a modest amount.

Other techniques for achieving a distribution of peak field values that is substantially equivalent to the distribution shown in FIG. 5C will now be described, initially with reference to FIGS. 22A–22C.

Figure 22A:
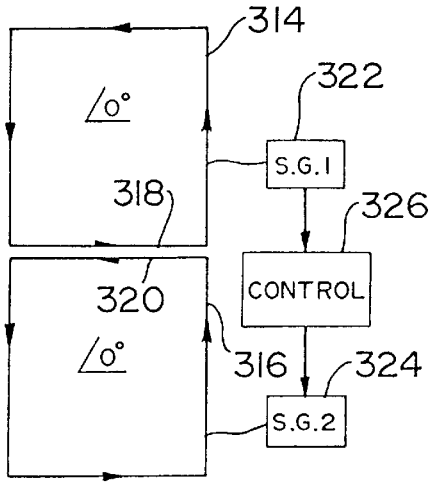
FIGS. 22A and 22B respectively illustrate alternative states of an antenna configuration provided for generating an interrogation field in accordance with another embodiment of the invention.
Figure 22B:
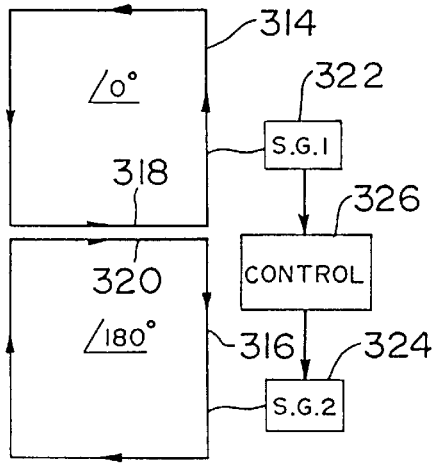

In the embodiment shown in FIGS. 22A and 22B, a pair of rectangular, stacked, co-planar antenna loops 314 and 316 is provided. A horizontal segment 318 of the loop 314 is arranged in parallel and in proximity with a horizontal segment 320 of the loop 316. It will be observed that the antenna configuration shown in FIGS. 22A and 22B includes only two co-planar loops, and that the segments 318 and 320 are the only pair of segments which are arranged in parallel and in proximity to each other.

Although the co-planar antenna loops shown in FIGS. 22A and 22B are rectangular, it should be noted that other loop shapes may be provided. For example, the embodiment shown in FIGS. 22A and 22B may be modified by replacing the loops 314 and 316 with a pair of co-planar triangular loops like the loops 114 and 116 shown in FIG. 7.

A signal generating circuit 322 is attached to the loop 314 to generate an alternating current in the loop 314 and a signal generating circuit 324 is connected to the loop 316 to generate an alternating current in the loop 316. A control circuit 326 is associated with the generating circuits 322 and 324 to establish desired timing relationships between the respective signals generated by the signal generating circuits.

In particular, the embodiment now being described is alternately operated in the two conditions shown in FIGS. 22A and 22B, respectively. As shown in FIG. 22A, in the first condition the antenna according to this embodiment is driven with the alternating currents in the loops 314 and 316 substantially in phase, while in the other condition, shown in FIG. 22B, the loops are driven substantially 180° out of phase. As a result, in the condition of FIG. 22A, the currents in the segments 318 and 320 are generated in opposite directions, resulting in substantial cancellation of the field components generated by the segments 318 and 320, so that the loops 314 and 316 are substantially equivalent to a single loop transmitter. On the other hand, in the condition shown in FIG. 22B, the antenna configuration made up of loops 314 and 316 is equivalent to a conventional figure-eight antenna, with the field components generated in the segments 318 and 320 reinforcing each other.

Figure 22C:
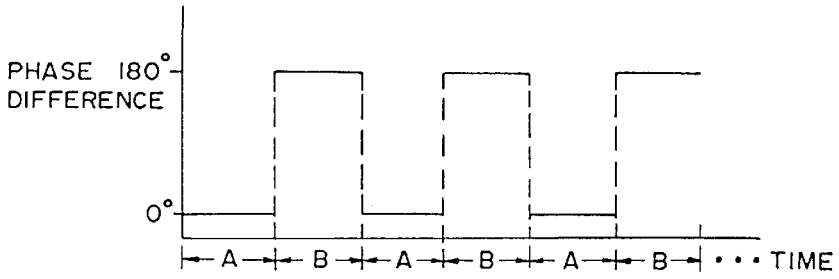
FIG. 22C is a timing diagram which illustrates operation of the embodiment of FIGS. 22A and 22B.

The timing at which the respective conditions shown in FIGS. 22A and 22B are provided is shown in the timing chart of FIG. 22C. The condition shown in FIG. 22A is provided during a sequence of time segments A, while the condition shown in FIG. 22B is provided during a sequence of time segments B, with the sequence of time segments B being interleaved with the sequence of time segments A.

Each of the time intervals A and B may be, for example, equivalent in duration to several cycles of the interrogation signal. By alternately switching the antenna configuration between a single-loop and a figure-eight configuration, it is possible to obtain a field profile equivalent to that shown in FIG. 5C, with the understanding that the field amplitude shown therein would be the maximum experienced over a time period which encompasses both an interval A and an interval B. Thus, the embodiment described in connection with FIGS. 22A–22C again results in a more even effective field distribution than is provided either by a single loop or a figure-eight antenna used alone.

Figure 24:
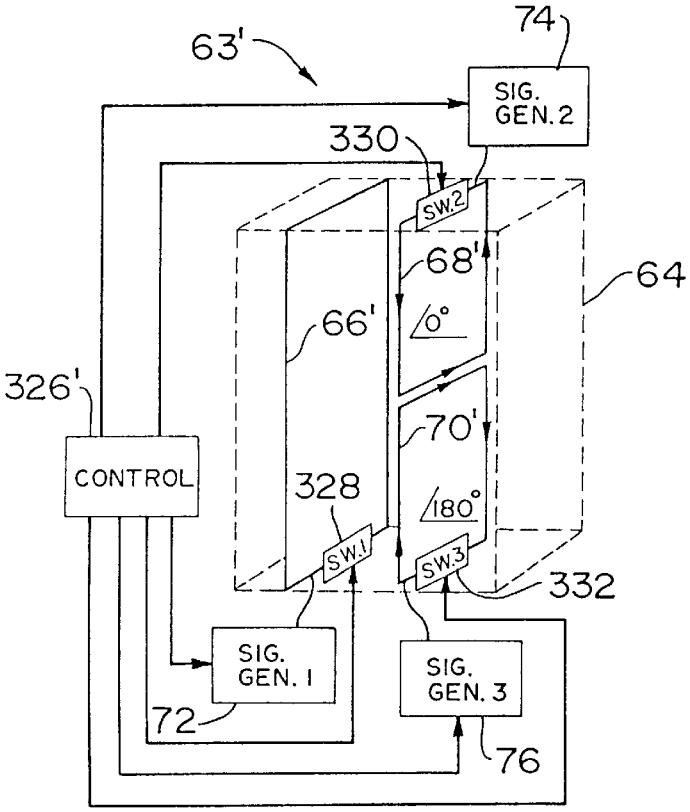
FIG. 24 illustrates an antenna configuration provided for generating an interrogation field according to the timing diagram of FIG. 23.
Figure 23:
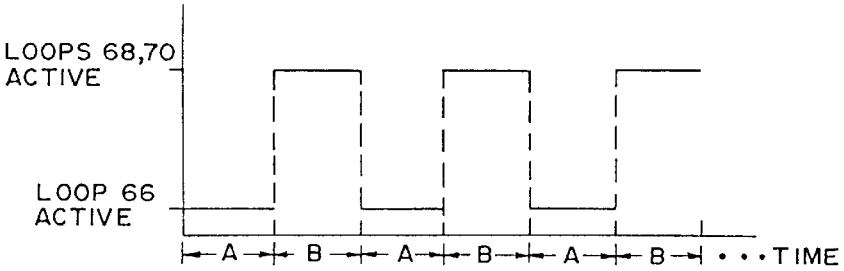
FIG. 23 is a timing diagram which illustrates operation of still another embodiment of the invention.

Switching back and forth between a single loop and a figure-eight antenna may be accomplished by other techniques in addition to that just described. For example, as indicated in FIG. 23, a dual-plane antenna like that shown in FIG. 4 may be operated so that the single loop 66 is active only during time intervals A and the figure-eight arrangement made up of loops 68 and 70 is active only during the sequence of time intervals B. A version of the embodiment of FIG. 4, suitably modified to operate according to the "time-slices" illustrated in FIG. 23, is shown in FIG. 24, and includes a control circuit 326' for providing the desired on and off timing for the signal generators 72, 74 and 76. In addition, the loops 66', 68' and 70' are respectively provided with switches 328, 230 and 332, which are controlled by the control circuit 326' so as to open-circuit the respective antenna loop during the time intervals in which the loop is not active. The open circuiting of the non-active loops prevents induction effects which would otherwise be experienced.

Figure 25:
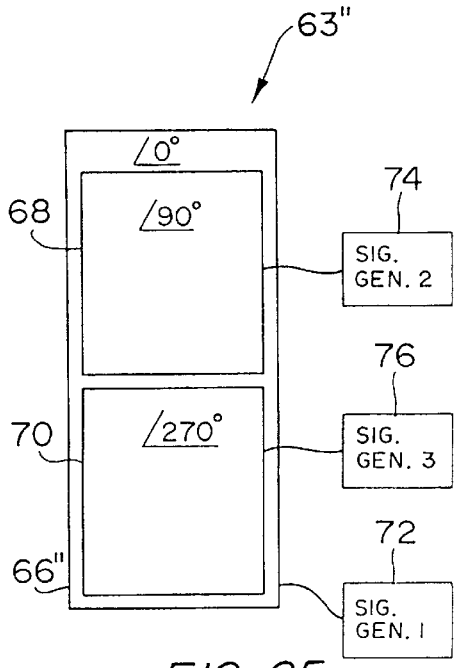
FIGS. 25–27 are illustrative of still further antenna configurations for generating interrogation fields in accordance with respective embodiments of the invention.
Figure 26:
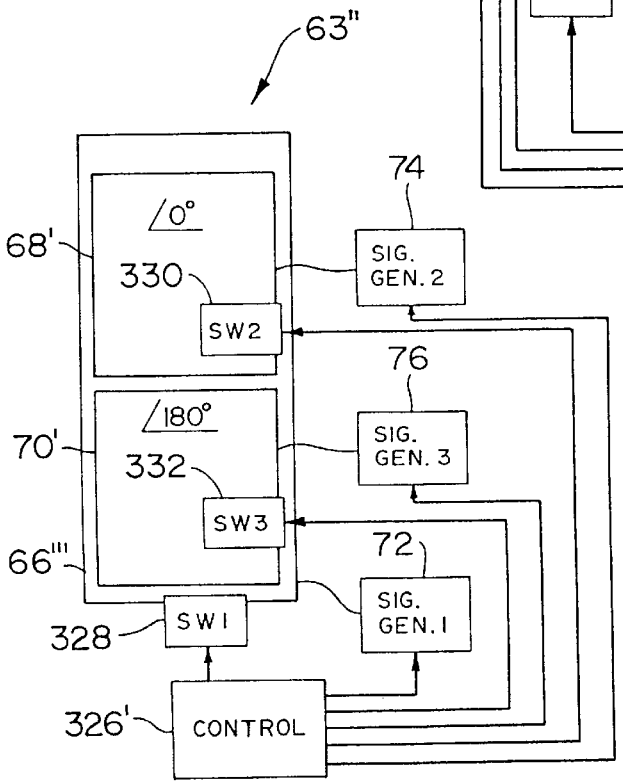

Other modifications of the antenna shown in FIG. 4 are illustrated in FIGS. 25 and 26, respectively. In each of FIGS. 25 and 26 it will be observed that the configuration of FIG. 4 has been made into a co-planar configuration, by slightly increasing the width and height of the loop 66 and arranging the loop 66 (shown as 66" or 66'" in FIGS. 25 and 26) in the same plane with the loops 68 and 70 (68' and 70' in FIG. 26) with the loop 66" or 66'" circumscribing the two other loops. In the modification shown in FIG. 25, the loops 68 and 70 are driven in quadrature relation with loop 66" and substantially out of phase with each other. That is, the same phase relationship among the currents of the loops is provided in FIG. 25 as in FIG. 4. On the other hand, in FIG. 26, the single loop 66'" and the figure-eight arrangement made up of loops 68' and 70' are respectively active in alternating sequences of time intervals, as in the arrangement illustrated in FIGS. 23 and 24.

It is to be understood that each of the quadrature dual-plane antennas shown in FIGS. 6 and 7 can be modified for alternating time interval operation in the same manner that the arrangement of FIG. 4 was modified to produce the arrangement of FIG. 24. In addition, the dual-plane antennas operated in alternating time intervals can be modified into co-planar arrangements analogous to the modification. of FIG. 4 illustrated in FIGS. 17 and 18. Modifications of the dual-plane alternating time interval antennas to form intersecting-plane alternating time interval antennas can be performed in an analogous manner to the modifications of FIG. 4 described above with reference to FIGS. 19–21.

Figure 27:
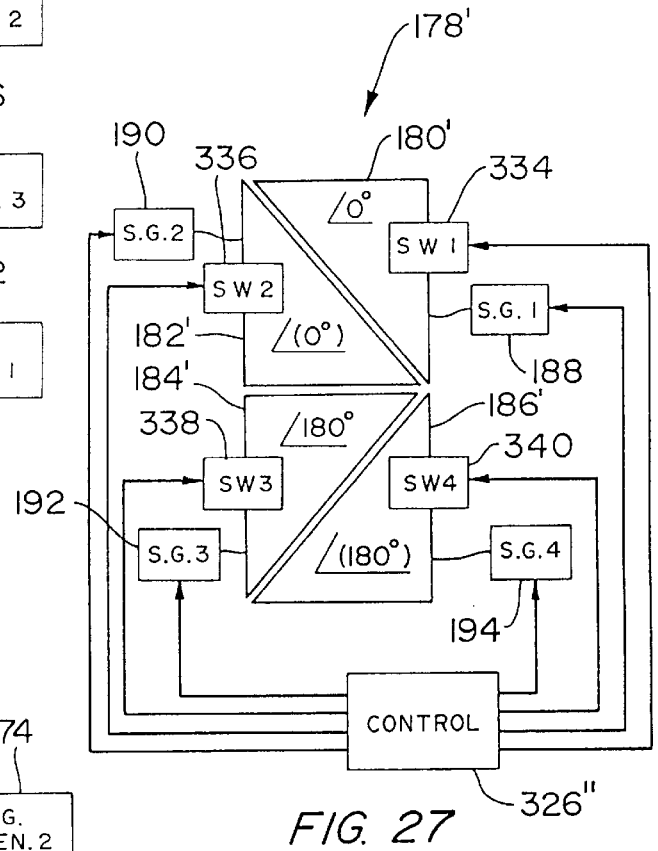

In addition to the co-planar antenna arrangement of FIG. 26, in which only three loops are provided, it is also contemplated to provide a far-field cancelling co-planar arrangement including four loops, that is, two pairs of loops with each pair driven in a respective interleaved sequence of time intervals. For example, the arrangement shown in FIG. 9 can be modified to produce the arrangement shown in FIG. 27. In FIG. 27, the triangular loops 180', 182', 184' and 186' are respectively provided with switches 334, 336, 338 and 340 and a control circuit 326" is provided to control the signal generators 188, 190, 192 and 194 and the switches 334, 336, 338 and 340 so that the pair of loops 180' and 184' is active during a sequence of time intervals A (FIG. 23) and the loops 182' and 186' are open-circuited during those intervals. In addition, during a sequence of intervals B (again, FIG. 23), interleaved with the intervals A, the pair of loops 182'and 186' is active and the loops 180' and 184' are open-circuited. It should be noted that a similar modification can be made to the antenna arrangements shown in FIGS. 10–12.

The concept of switching between a single loop and a figure-eight loop arrangement, as discussed above in connection with FIGS. 22A–22C, can also be applied to a receive antenna arrangement like that of FIG. 15. Such a switched receive antenna arrangement will now be described with reference to FIGS. 28 and 29.

Figure 28:
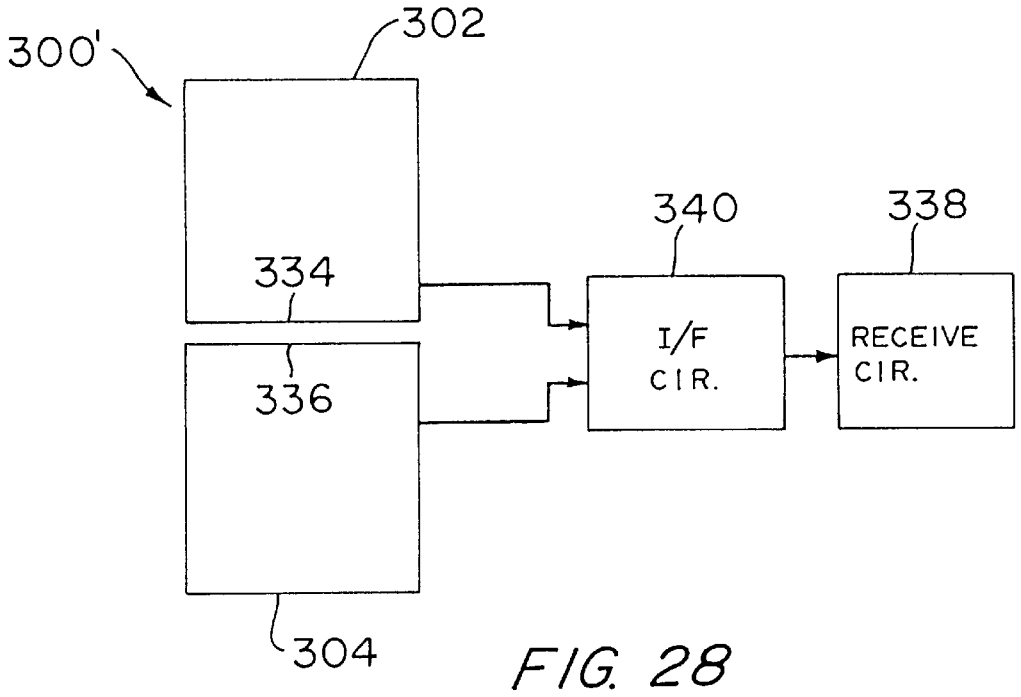
FIG. 28 schematically illustrates an antenna configuration used for receiving a marker signal in accordance with a further embodiment of the invention.

The arrangement shown in FIG. 28 includes the same receive antenna loops as in FIG. 15. Loop 302 has a horizontal segment 334 arranged in parallel and in proximity to a horizontal segment 336 of loop 304. It will be observed that the receive antenna arrangement of FIG. 28 does not include any loops in addition to the loops 302 and 304 and does not have any pair of loop segments arranged in parallel and in proximity to each other except for the loop segments 334 and 336.

The arrangement of FIG. 28 also includes a receive circuit 338 connected to the antenna loops 302 and 304 by a switchable interface circuit 340.

Figure 29:
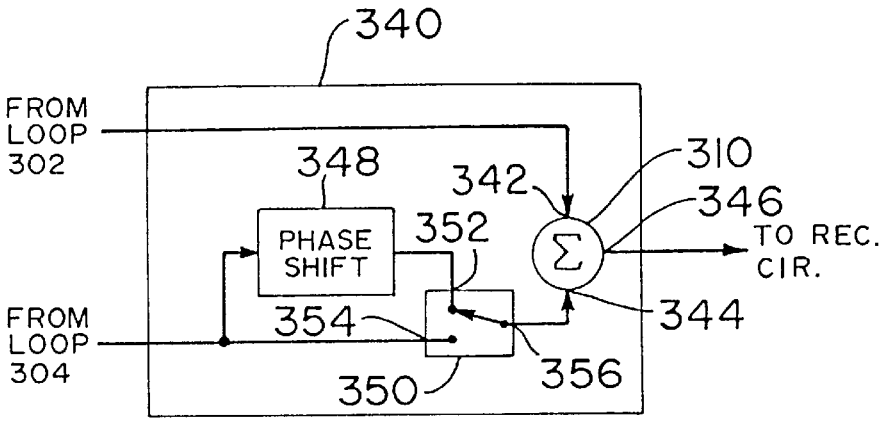
FIG. 29 illustrates a switchable interface circuit that forms part of the receiver antenna configuration of FIG. 28.

Details of the interface circuit 340 are shown in FIG. 29. The interface circuit 340 includes a summation circuit 310 which has inputs 342 and 344 and an output connected to the receive circuit 338 for providing to the receive circuit 338 a sum signal formed by the summation circuit 310 from the signals respectively provided to its inputs. The interface circuit 340 also includes a phase shift circuit 348 which provides a phase shift of 180° to a signal input thereto and outputs the resulting phase-shifted signal. The interface circuit 340 also includes a switching circuit 350.

The input 342 of the summation circuit 310 is connected to receive the received signal provided from the antenna loop 302. The phase shift circuit 348 is connected to receive the received signal provided from the other antenna loop 304, and the phase-shifted signal output from the phase shift circuit 348 is provided to an input 352 of the switching circuit 350. The switching circuit 350 has another input 354 which is connected directly to receive the received signal from loop 304 without phase shift. An output 356 of the switching circuit 350 is connected to the input 344 of the summation circuit 310.

The switching circuit 350 is switchable between a position (shown in FIG. 29) in which the phase-shifted signal output from the phase shift circuit 348 is supplied to the input 344 of the summation circuit 310 and an alternative position in which the received signal from the loop 304 is supplied without phase shift to the input 344 of the summation circuit 310.

The latter condition of the switching circuit 350 is maintained during time intervals A (see FIG. 22C) so that the antenna arrangement of FIG. 28 operates substantially as a single loop antenna during the time intervals A. On the other hand, during an interleaved sequence of time intervals B, the switch 350 is maintained in the condition shown in FIG. 29, so that a signal from loop 304, phase shifted by 180°, is provided to the summation circuit 310. As a result, during the intervals B the antenna arrangement of FIG. 28 is essentially equivalent to a figure-eight arrangement. In this way, a relatively uniform sensitivity to signals present in the interrogation zone can be achieved.

Instead of providing a 180° phase shift in one of the inputs for summation circuit 310 during the time intervals B, phase shifts can be applied to both of the inputs for summation circuit 310 during the time intervals B, so as to have the inputs 180° out of phase with each other. For example, a +90° phase shift can be applied to one input while applying a −90° phase shift to the other input.

Although the embodiments described herein have been presented solely as either receiving or transmitting antennas, it is also contemplated that the antenna configurations of the various embodiments be used both for transmitting and receiving.

Various other changes in the foregoing antenna configurations may be introduced without departing from the invention. The particularly preferred embodiments are thus intended in an illustrative and not limiting sense. The true spirit and scope of the invention is set forth in the following claims.

What is claimed is:

1. An antenna for use in an EAS system, comprising:

first, second, third and fourth loops, all co-planar; and excitation means for generating respective alternating currents in said first, second, third and fourth loops, such that the alternating current in said second loop is about 90° out of phase with the alternating current in said first loop, the alternating current in said third loop is about 180° out of phase with the alternating current in said first loop, and the alternating current in said fourth loop is about 180° out of phase with the alternating current in said second loop;

said four loops collectively including a plurality of vertical segments and no two vertical segments in said antenna being vertically aligned with each other.

2. An antenna for use in an EAS system, comprising:

first, second, third and fourth loops, all co-planar; and excitation means for generating respective alternating currents in said first, second, third and fourth loops, such that the alternating current in said second loop is about 90° out of phase with the alternating current in said first loop, the alternating current in said third loop is about 180° out of phase with the alternating current in said first loop, and the alternating current in said fourth loop is about 180° out of phase with the alternating current in said second loop;

said four loops collectively including at least one pair of vertical segments having respective alternating currents that are 180° out of phase with each other; and in each said pair of vertical segments the two vertical segments making up the pair of vertical segments are displaced horizontally with respect to each other.

3. An antenna according to claim 2, wherein said four loops collectively include at least one pair of vertical segments having respective alternating currents that are about 180° out of phase with each other and in which the vertical segments of the pair are displaced from each other vertically as well as horizontally.

4. An antenna according to claim 2, wherein all four of said loops are substantially equal in area.

5. An antenna for use in an EAS system, comprising:

first, second, third and fourth loops, all triangular and co-planar; and excitation means for generating respective alternating currents in said first, second, third and fourth loops, such that the alternating current in said second loop is about 90° out of phase with the alternating current in said first loop, the alternating current in said third loop is about 180° out of phase with the alternating current in said first loop, and the alternating current in said fourth loop is about 180° out of phase with the alternating current in said second loop.

6. An antenna according to claim 5, wherein said four loops are positioned together to form a coil array having a substantially rectangular profile.

* * * * *

UNITED STATES PATENT AND TRADEMARK OFFICE

CERTIFICATE OF CORRECTION

PATENT NO. : 6,081,238
DATED : June 27, 2000
INVENTOR(S) : Jorge Alicot, et al.

It is certified that error appears in the above-identified patent and that said Letters Patent is hereby corrected as shown below:

Column 17,
Line 41, delete "angle e" and insert -- angle θ --.
Line 45, delete "values of e" and insert -- values of θ --.

Column 19,
Line 40, delete "modification. of" and insert -- modification of --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*